US006565328B2

(12) United States Patent
Staton et al.

(10) Patent No.: US 6,565,328 B2
(45) **Date of Patent: *May 20, 2003**

(54) SELF ALIGNING CARTRIDGE PUMP

(75) Inventors: Timothy Matthew Staton, Ypsilanti, MI (US); Bernard Dale Baughn, Livonia, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/751,028

(22) Filed: Dec. 29, 2000

(65) Prior Publication Data

US 2002/0085920 A1 Jul. 4, 2002

(51) Int. Cl.[7] ..... F04B 17/00; F04B 35/00

(52) U.S. Cl. ..... 417/53; 417/53; 417/360; 415/213.1; 415/129; 418/149

(58) Field of Search ..... 417/53, 359, 360, 417/540, 543, 312; 418/149, 270; 415/213.1, 214.1, 129, 133

(56) References Cited

U.S. PATENT DOCUMENTS

| | | | | | |
|---|---|---|---|---|---|
| 3,829,248 | A | * | 8/1974 | Bright et al. | 417/410 |
| 4,470,764 | A | * | 9/1984 | Anderson et al. | 417/299 |
| 4,514,155 | A | * | 4/1985 | Ogawa | 418/149 |
| 4,752,195 | A | * | 6/1988 | Friedrich et al. | 417/540 |
| 6,042,343 | A | * | 3/2000 | Semba et al. | 417/220 |
| 6,149,409 | A | * | 11/2000 | Palakodati et al. | 418/15 |
| 6,305,919 | B1 | * | 10/2001 | Staton et al. | 417/540 |

* cited by examiner

*Primary Examiner*—Charles G. Freay
*Assistant Examiner*—Han L. Liu
(74) *Attorney, Agent, or Firm*—John E. Kajander, Esq.

(57) ABSTRACT

A self-aligning cartridge pump 10 is provided including a pumping mechanism 24, a curved upper plate 30, and a retaining ring 32. The curved upper plate 30 is in communication with the retaining ring 32 such that the self-aligning cartridge pump 10 can pivot into proper alignment.

7 Claims, 1 Drawing Sheet

SELF ALIGNING CARTRIDGE PUMP

TECHNICAL FIELD

The present invention relates generally to a cartridge pump, and more particularly to a cartridge pump with self-aligning features.

BACKGROUND

A wide variety of cartridge pumps are known in the prior art. Cartridge pumps are used in a wide variety of applications. Commonly cartridge pumps consist of a cartridge housing surrounding a pumping mechanism (or cam-pack). Passageways formed within the cartridge housing allow fluid to communicate with the pumping mechanism. Often, an external motor and drive shaft are used to power the pumping mechanism within the cartridge pump.

It is known, however, that the interaction between the external motor and drive shaft and the pumping mechanism within the cartridge pump can interfere with the proper operation of the cartridge pump. If the axis of the drive shaft is not perpendicular to the pumping mechanism, it is possible that the pumping mechanism may be angled within the cartridge housing. At a minimum, such a situation can result in increased friction and increased force required to active the cartridge pump. In more extreme examples, this situation may result in incorrect operation of the cartridge pump, damage to the cartridge pump, or even failure of the cartridge pump. This is highly undesirable.

Proper alignment of the cartridge pump with the external drive shaft is commonly accomplished through the use of tight tolerances in manufacturing and assembly. Although such procedures can reduce incidents of misalignment, they can also increase the cost and time of assembly and manufacturing. In addition, misalignment can still occur in post manufacturing situations such as repair, replacement, or even vibrations during use.

It would, therefore, be highly desirable to have a cartridge pump with improved alignment characteristics and without the need for tight manufacturing and assembly tolerances. In addition, it would be highly desirable to have a cartridge pump whose alignment characteristics would help provide proper alignment with the drive shaft in post manufacturing and assembly situations.

SUMMARY OF THE INVENTION

It is, therefore, an object of the present invention to provide a cartridge pump with improved alignment characteristics. It is a further object of the present invention to provide such improved alignment characteristics without the need for increased manufacturing and assembly tolerances.

In accordance with the objects of the present invention, a self-aligning cartridge pump for use with an external drive shaft is provided. The self-aligning cartridge pump includes a pumping mechanism, a cylindrical cartridge housing, and a retaining ring. The cylindrical cartridge housing has a curved upper plate. The retaining ring is in communication with the curved upper plate and allows the cartridge housing to pivot. The ability of the cylindrical cartridge housing to pivot on its connection with the retaining ring permits the pumping mechanism to naturally align perpendicularly with the drive shaft.

Other objects and features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
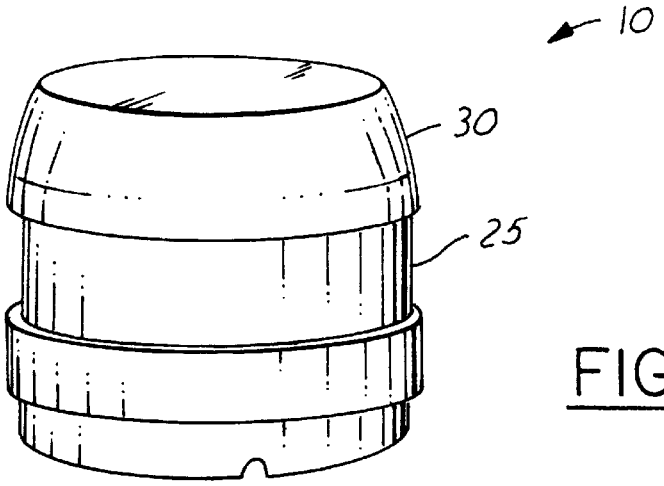
FIG. 1 is an illustration of an embodiment of a self-aligning cartridge pump in accordance with the present invention.

Referring now to FIG. 1, which is an illustration of a self-aligning cartridge pump 10 in accordance with the present invention. Self-aligning cartridge pump 10 is preferably for use in an automotive power steering system, although a self-aligning cartridge pump 10 may be used in a wide variety of applications, including non-automotive applications.

Figure 2:
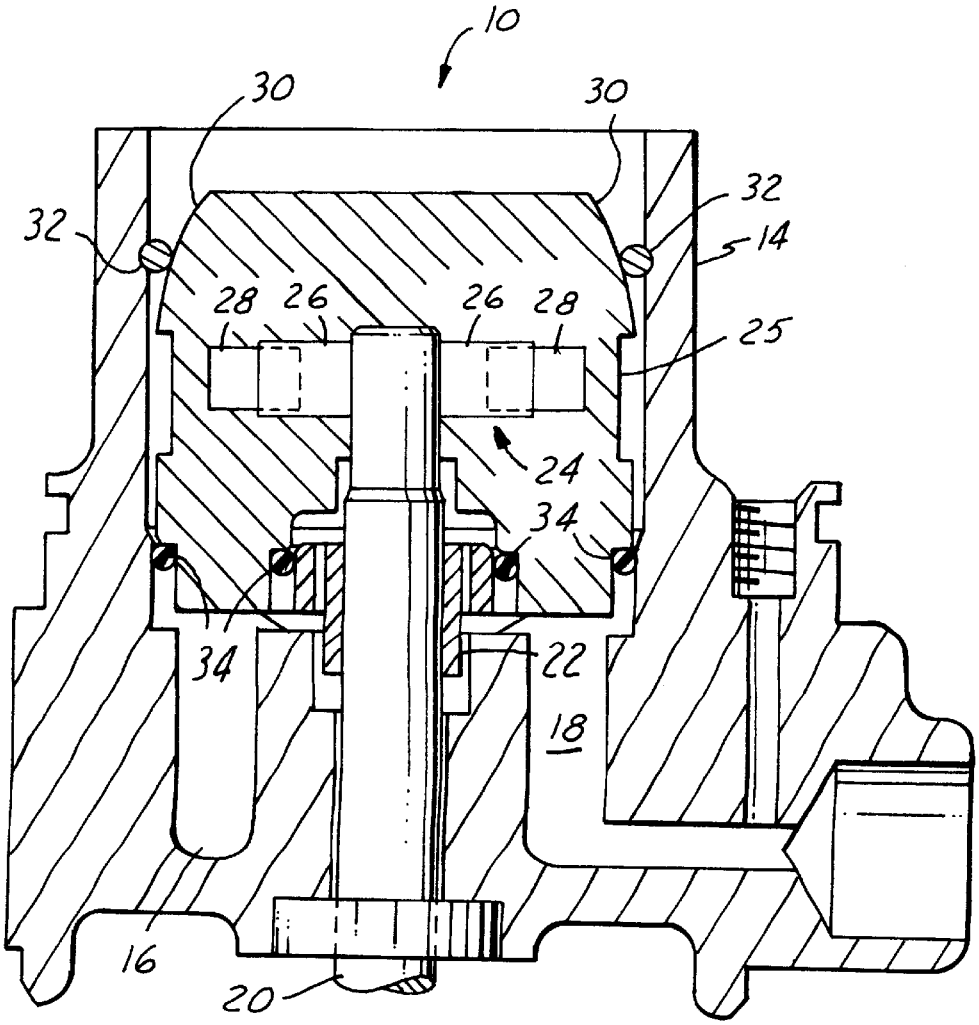
FIG. 2 is a cross-sectional illustration of an embodiment of a self-aligning cartridge steering pump in accordance with the present invention.

Referring now to FIG. 2, which is a cross-sectional illustration of a self-aligning cartridge pump 10 in accordance with the present invention shown positioned within a motor housing 14. The motor housing 14 is shown strictly for illustrative purposes, and is not intended to create a limitation of the present invention. A wide variety of motor housings 14 and other encasements may be used to hold the self-aligning cartridge pump 10. The motor housing 14 is illustrated showing an input reservoir 16, an output reservoir 18, a drive shaft 20, and shaft bearings 22. Although these elements are shown, it should be understood that a vast array of motor housing 14 designs are well known in the prior art and contemplated by the invention.

The input shaft 20 is used to engage and drive a pumping mechanism 24 positioned within a cylindrical cartridge housing 25 of the self-aligning cartridge pump 10. Although a wide variety of pumping mechanisms 24 are well known in the prior art one contemplated pumping mechanism 24 includes cam element 26 and vane elements 28. Other pumping mechanisms 24 such as impellers and other known systems are also contemplated by the invention. In the prior art, a misalignment between the input shaft 20 and the pumping mechanism 25 has been known to lead to potential problems in pump operation. A misalignment may cause undesirable friction between pumping mechanism 24 and the cylindrical cartridge housing 25. This may lead to improper operation of the pumping mechanism 24, or even damage to the pumping mechanism 24.

The present invention includes a curved upper plate 30 and a retaining ring 32. The curved upper plate 30 allows the self-aligning cartridge pump 10 to pivot against retaining ring 32 and thereby naturally align the pumping mechanism 24 with the input shaft 20. The forces caused by misalignment with the input shaft 20 will cause the self-aligning cartridge pump 10 to shift into correct alignment. In addition, the curved upper plate 30 allows self-aligning cartridge pump 10 to be adequately secured in a variety of positions within the motor housing 14 by allowing retaining ring 32 to remain in constant contact with the self-aligning cartridge pump 10 throughout a variety of angles.

Although the retaining ring 32 is illustrated as a separate element, in other embodiments, it is possible for the retaining ring 32 to be formed directly as part of the motor housing 14. In addition, although the curved upper plate 30 is shown with a particular curve, a wide variety of curved surfaces are contemplated. It is contemplated that the curve of the curved upper plate 30 may be adjusted to control the amount of pivot the self-aligning cartridge pump 10 is capable of moving. The self-aligning cartridge pump 10 may additionally include O-rings 34. The O-rings 34 provide a seal between the self-aligning cartridge pump 10 and the motor housing 14 while additionally allowing the self-aligning cartridge pump 10 to pivot into correct alignment. Although the O-rings 34 are shown, a wide variety of mechanisms are known that would allow the self-aligning cartridge pump 10 to remain adequately sealed to the motor housing 14 while retaining its ability to pivot and correct alignment.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A self-aligning cartridge pump for use with an external input shaft comprising:

a pumping mechanism;

a cylindrical cartridge housing with a curved upper plate; and a retaining ring in communication with said curved upper plate such that said cylindrical cartridge housing naturally pivots to align with the external pumping shaft, said retaining ring formed as a integral part of a motor housing.

2. A self-aligning pump for use with an external input shaft comprising:

a pumping mechanism;

a cylindrical cartridge housing with a curved upper plate;

a retaining ring in communication with said curved upper plate such that said cylindrical cartridge housing naturally pivots to align with the external pumping shaft; and at least one O-ring element, said at least one O-ring element providing a seal between said self aligning cartridge pump and a motor housing throughout a variety of pivot positions.

3. A self-aligning cartridge pump as described in claim 2 wherein said pumping mechanism is comprised of a cam element and a plurality of vane elements.

4. A self-aligning cartridge pump as described in claim 2 wherein said pumping mechanism is comprised of an impeller.

5. A self-aligning cartridge pump as described in claim 2 wherein said retaining ring is formed as an integral part of a motor housing.

6. A self-aligning cartridge pump as described in claim 2 wherein said cylindrical cartridge housing and said curved upper plate are formed as a single element.

7. A method of improving cartridge pump alignment with an external input shaft comprising:

installing a cylindrical cartridge housing having a curved tipper plate into a motor housing;

sealing said cylindrical cartridge housing to said motor housing utilizing a O-ring element positioned between said cylindrical cartridge housing and said motor housing;

installing a retaining ring in communication with said curved upper plate to secure said cylindrical cartridge housing within said motor housing, said retaining ring positioned such that said cylindrical cartridge housing pivots relative to said motor housing; and aligning said cylindrical cartridge housing to an external pumping shaft through said pivoting action.

* * * * *

UNITED STATES PATENT AND TRADEMARK OFFICE

CERTIFICATE OF CORRECTION

PATENT NO. : 6,565,328 B2
DATED : May 20, 2003
INVENTOR(S) : Timothy Matthew Staton et al.

It is certified that error appears in the above-identified patent and that said Letters Patent is hereby corrected as shown below:

Column 3,
Line 26, should read -- an integral part --

Column 4,
Line 21, delete “tipper” and insert -- upper --

Signed and Sealed this

Twenty-first Day of September, 2004

JON W. DUDAS
*Director of the United States Patent and Trademark Office*